US009562681B2

(12) United States Patent
Colannino et al.

(10) Patent No.: US 9,562,681 B2
(45) Date of Patent: Feb. 7, 2017

(54) BURNER HAVING A CAST DIELECTRIC ELECTRODE HOLDER

(71) Applicant: ClearSign Combustion Corporation, Seattle, WA (US)

(72) Inventors: Joseph Colannino, Bellevue, WA (US); Igor A. Krichtafovitch, Kirkland, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 407 days.

(21) Appl. No.: 14/101,328

(22) Filed: Dec. 9, 2013

(65) Prior Publication Data

US 2014/0170577 A1 Jun. 19, 2014

Related U.S. Application Data

(60) Provisional application No. 61/735,979, filed on Dec. 11, 2012.

(51) Int. Cl.
*F23Q 2/32* (2006.01)
*F23C 99/00* (2006.01)

(52) U.S. Cl.
CPC ..... *F23C 99/001* (2013.01); *F23K 2301/101* (2013.01)

(58) Field of Classification Search
CPC ..... F23C 99/001; F23D 11/32; H05H 1/34; H05H 1/2406; H05H 2001/2412
See application file for complete search history.

(56) References Cited

U.S. PATENT DOCUMENTS

| | | | | |
|---|---|---|---|---|
| 1,153,182 A | | 9/1915 | Schniewind | |
| 2,604,936 A | * | 7/1952 | Kaehni | F23C 99/001 122/14.21 |
| 3,087,472 A | | 4/1963 | Asakawa | |
| 3,167,109 A | * | 1/1965 | Wobig | F23C 99/001 239/690 |
| 3,224,485 A | * | 12/1965 | Blomgren, Sr. | F23C 99/001 165/903 |
| 3,306,338 A | * | 2/1967 | Wright | F23C 99/001 361/233 |
| 3,358,731 A | | 12/1967 | Donnelly | |
| 3,416,870 A | | 12/1968 | Wright | |

(Continued)

FOREIGN PATENT DOCUMENTS

| | | |
|---|---|---|
| EP | 1139020 | 8/2006 |
| JP | 60-216111 | 10/1985 |
| JP | 61-265404 | 11/1986 |

OTHER PUBLICATIONS

U.S. Appl. No. 14/061,477, filed Oct. 3, 2013, Krichtafovitch et al.

(Continued)

*Primary Examiner* — Jason Lau
(74) *Attorney, Agent, or Firm* — Christopher A. Wiklof; Nicholas S. Bromer; Launchpad IP, Inc.

(57) ABSTRACT

A burner may include a dielectric body configured to hold one or more electrodes in proximity to a combustion reaction. The dielectric body may be cast from a refractory material. The one or more electrodes may be cast into the dielectric body. The dielectric body and the electrodes may be configured for installation, removal, and replacement as a unit.

45 Claims, 7 Drawing Sheets

(56) References Cited

U.S. PATENT DOCUMENTS

| | | | | | |
|---|---|---|---|---|---|
| 3,503,348 | A | | 3/1970 | Dvirka | |
| 3,749,545 | A | | 7/1973 | Velkoff | |
| 3,841,824 | A | | 10/1974 | Bethel | |
| 3,869,362 | A | | 3/1975 | Machi et al. | |
| 4,052,139 | A | | 10/1977 | Paillaud et al. | |
| 4,091,779 | A | | 5/1978 | Saufferer et al. | |
| 4,093,430 | A | | 6/1978 | Schwab et al. | |
| 4,110,086 | A | | 8/1978 | Schwab et al. | |
| 4,111,636 | A | | 9/1978 | Goldberg | |
| 4,118,202 | A | | 10/1978 | Scholes | |
| 4,125,359 | A | * | 11/1978 | Lempa | F23M 5/025 239/397.5 |
| 4,144,016 | A | * | 3/1979 | Takahashi | F23D 11/00 431/175 |
| 4,219,001 | A | | 8/1980 | Kumagai et al. | |
| 4,260,394 | A | | 4/1981 | Rich | |
| 4,304,096 | A | | 12/1981 | Liu et al. | |
| 4,340,024 | A | | 7/1982 | Suzuki et al. | |
| 4,439,980 | A | | 4/1984 | Biblarz et al. | |
| 4,580,969 | A | * | 4/1986 | Brachet | F27D 1/002 126/39 K |
| 4,624,631 | A | * | 11/1986 | Kobayashi | F23D 11/40 431/116 |
| 4,649,260 | A | | 3/1987 | Melis et al. | |
| 4,675,029 | A | | 6/1987 | Norman et al. | |
| 4,799,879 | A | * | 1/1989 | Laspeyres | F23D 14/14 431/328 |
| 4,903,616 | A | | 2/1990 | Mavroudis | |
| 4,987,839 | A | | 1/1991 | Krigmont et al. | |
| 5,217,363 | A | * | 6/1993 | Brais | F23D 14/22 239/401 |
| 5,702,244 | A | | 12/1997 | Goodson et al. | |
| 6,374,909 | B1 | | 4/2002 | Jeter et al. | |
| 6,640,549 | B1 | | 11/2003 | Wilson et al. | |
| 6,736,133 | B2 | | 5/2004 | Bachinski et al. | |
| 6,742,340 | B2 | | 6/2004 | Nearhoof, Sr. et al. | |
| 6,918,755 | B1 | | 7/2005 | Johnson et al. | |
| 7,137,808 | B2 | | 11/2006 | Branston et al. | |
| 7,168,427 | B2 | | 1/2007 | Bachinski et al. | |
| 7,182,805 | B2 | | 2/2007 | Reaves | |
| 7,226,496 | B2 | | 6/2007 | Ehlers | |
| 7,226,497 | B2 | | 6/2007 | Ashworth | |
| 7,243,496 | B2 | | 7/2007 | Pavlik et al. | |
| 7,377,114 | B1 | | 5/2008 | Pearce | |
| 7,845,937 | B2 | | 12/2010 | Hammer et al. | |
| 8,082,725 | B2 | | 12/2011 | Younsi et al. | |
| 8,245,951 | B2 | | 8/2012 | Fink et al. | |
| 8,851,882 | B2 | | 10/2014 | Hartwick et al. | |
| 9,151,549 | B2 | | 10/2015 | Goodson et al. | |
| 2005/0155992 | A1 | * | 7/2005 | Klingensmith | B22D 18/04 222/597 |
| 2007/0020567 | A1 | * | 1/2007 | Branston | F02M 27/04 431/8 |
| 2007/0042300 | A1 | * | 2/2007 | Movassaghi | F23C 15/00 431/1 |
| 2008/0169028 | A1 | * | 7/2008 | Moore | B05B 1/00 137/15.04 |
| 2011/0072786 | A1 | | 3/2011 | Tokuda et al. | |
| 2012/0317985 | A1 | | 12/2012 | Hartwick et al. | |
| 2013/0004902 | A1 | | 1/2013 | Goodson et al. | |
| 2013/0071794 | A1 | | 3/2013 | Colannino et al. | |
| 2013/0170090 | A1 | | 7/2013 | Colannino et al. | |
| 2013/0230810 | A1 | | 9/2013 | Goodson et al. | |
| 2013/0230811 | A1 | | 9/2013 | Goodson et al. | |
| 2013/0255482 | A1 | | 10/2013 | Goodson | |
| 2013/0255548 | A1 | | 10/2013 | Goodson et al. | |
| 2013/0255549 | A1 | | 10/2013 | Sonnichsen et al. | |
| 2013/0260321 | A1 | | 10/2013 | Colannino et al. | |
| 2013/0323655 | A1 | | 12/2013 | Krichtafovitch et al. | |
| 2013/0323661 | A1 | | 12/2013 | Goodson et al. | |
| 2013/0333279 | A1 | | 12/2013 | Osler et al. | |
| 2013/0336352 | A1 | | 12/2013 | Colannino et al. | |
| 2014/0038113 | A1 | | 2/2014 | Breidenthal et al. | |
| 2014/0050644 | A1 | | 2/2014 | Colannino et al. | |
| 2014/0051030 | A1 | | 2/2014 | Colannino et al. | |
| 2014/0065558 | A1 | | 3/2014 | Colannino et al. | |
| 2014/0076212 | A1 | | 3/2014 | Goodson et al. | |
| 2014/0080070 | A1 | | 3/2014 | Krichtafovitch et al. | |
| 2014/0162195 | A1 | | 6/2014 | Lee et al. | |
| 2014/0162196 | A1 | | 6/2014 | Krichtafovitch et al. | |
| 2014/0162197 | A1 | | 6/2014 | Krichtafovitch et al. | |
| 2014/0162198 | A1 | | 6/2014 | Krichtafovitch et al. | |
| 2014/0170571 | A1 | | 6/2014 | Krichtafovitch et al. | |
| 2014/0170577 | A1 | | 6/2014 | Colannino et al. | |
| 2014/0208758 | A1 | | 7/2014 | Breidenthal et al. | |
| 2014/0338350 | A1 | | 11/2014 | Breidenthal | |
| 2015/0079524 | A1 | | 3/2015 | Colannino et al. | |
| 2015/0107260 | A1 | | 4/2015 | Colannino et al. | |
| 2015/0121890 | A1 | | 5/2015 | Colannino et al. | |
| 2015/0140498 | A1 | | 5/2015 | Colannino | |
| 2015/0147704 | A1 | | 5/2015 | Krichtafovitch et al. | |
| 2015/0147705 | A1 | | 5/2015 | Colannino et al. | |
| 2015/0147706 | A1 | | 5/2015 | Krichtafovitch et al. | |
| 2015/0219333 | A1 | | 8/2015 | Colannino et al. | |
| 2015/0241057 | A1 | | 8/2015 | Krichtafovitch et al. | |
| 2015/0338089 | A1 | | 11/2015 | Krichtafovitch et al. | |

OTHER PUBLICATIONS

Altendrfner et al., "Electric Field Effects on Emissions and Flame Stability With Optimized Electric Field Geometry", Third European Combustion Meeting ECM 2007, p. 1-6.

William T. Brande; "The Bakerian Lecture: on Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

* cited by examiner

BURNER HAVING A CAST DIELECTRIC ELECTRODE HOLDER

CROSS-REFERENCE TO RELATED APPLICATIONS

The present application claims priority benefit from U.S. Provisional Patent Application No. 61/735,979, entitled "BURNER HAVING A CAST DIELECTRIC ELECTRODE HOLDER", filed Dec. 11, 2012; which, to the extent not inconsistent with the disclosure herein, is incorporated by reference.

SUMMARY

According to an embodiment, a burner configured for application of electrical energy to a combustion reaction includes a combustor wall disposed to at least partially bind a combustion volume to separate the combustion volume from an external volume. At least one fuel nozzle is configured to output a stream of fuel into the combustion volume to support a combustion reaction in the combustion volume. At least one air flow passage is configured to allow air to enter the combustion volume to support the combustion reaction. A dielectric body extends at least partly into the combustion volume, the dielectric body being formed from a cast refractory material. One or more electrodes extend substantially through the dielectric body. The one or more electrodes are configured to convey electrical energy from the external volume to a location proximate to or coincident with the combustion reaction.

DETAILED DESCRIPTION

Figure 1:
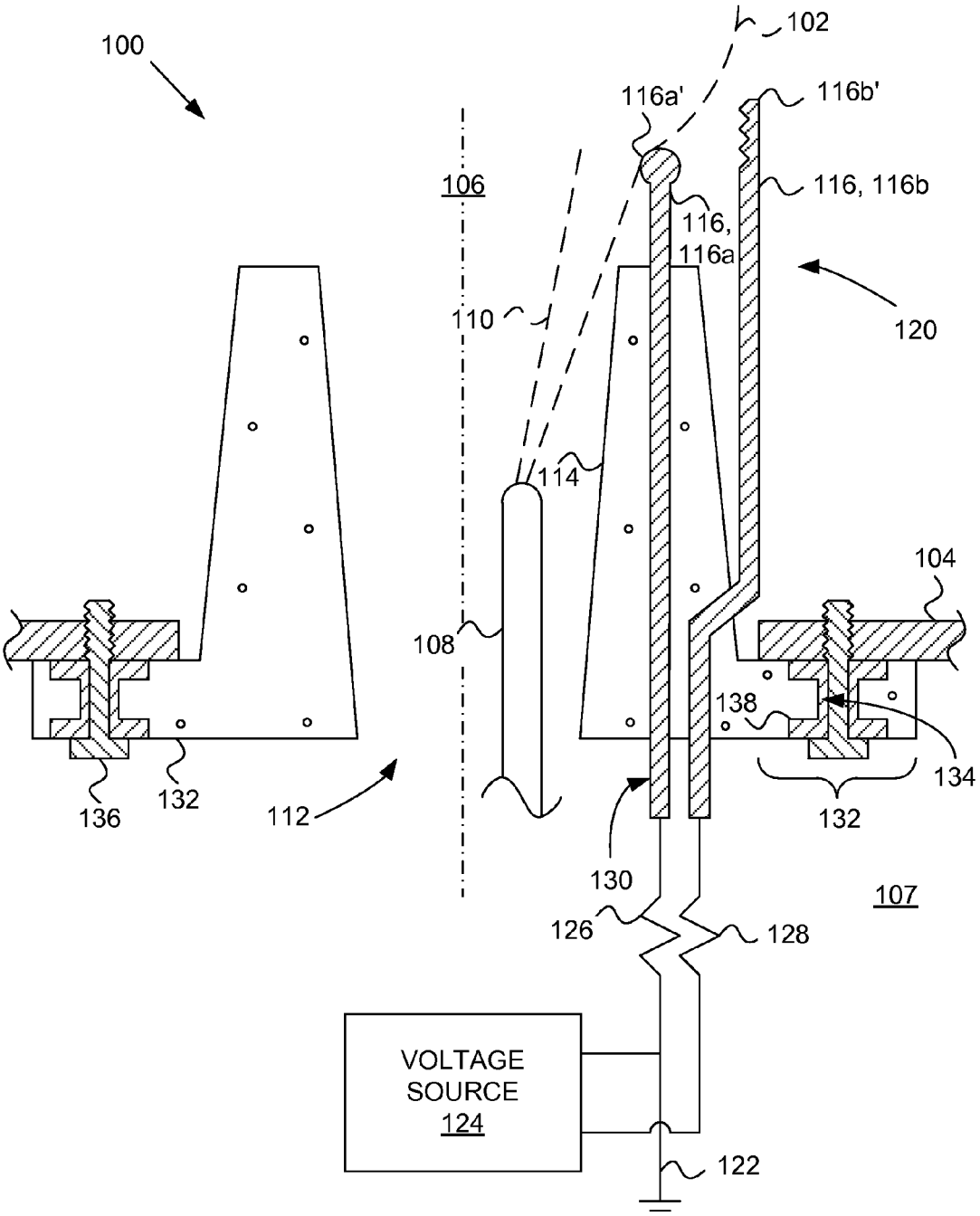
FIG. 1 is a diagram of a burner configured for application of electrical energy to a combustion reaction, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a diagram of a burner 100 configured for application of electrical energy to a combustion reaction, according to an embodiment.

According to various embodiments, a burner 100 is configured for application of electrical energy to a combustion reaction 102, and includes a combustor wall 104 disposed to at least partially bind a combustion volume 106 to separate the combustion volume 106 from an external volume 107. At least one fuel nozzle 108 is configured to output a stream of fuel 110 into the combustion volume 106 to support the combustion reaction 102 in the combustion volume 106. At least one air flow passage 112 is configured to at least allow air to enter the combustion volume 106 to support the combustion reaction 102. A dielectric body 114 extends at least partly into the combustion volume 106. The dielectric body 114 is formed from a cast refractory material. One or more electrodes 116 extend substantially through the dielectric body 114 and are configured to convey electrical energy from the external volume 107 to a location 120 proximate to or coincident with the combustion reaction 102.

According to various embodiments, the dielectric body 114 can be configured to operate, under at least one condition, as a bluff body for holding the combustion reaction 102. Additionally or alternatively, the dielectric body 114 can be configured to at least partly define the at least one air flow passage 112. At least one fuel nozzle 108 can be configured to direct at least a portion of at least one stream of fuel 110 to impinge onto the dielectric body 114.

According to various embodiments, the dielectric body 114 can be configured to electrically insulate or electrically isolate the one or more electrodes 116 extending substantially therethrough along all or a portion of the one or more electrodes 116. The one or more electrodes 116 can include an electrode **116*a* configured to be operatively coupled to an electrical ground 122. The one or more electrodes 116 can include an electrode 116*a* configured to provide a combustion reaction support point 116*a*'. The electrode 116*a* can be configured to provide a combustion reaction support point 116*a*' that can be configured to operatively couple to ground 122 or to a voltage source 124 through a current limiting resistor 126. Additionally or alternatively, the electrode 116*a* can be configured to provide a combustion reaction support point 116***a*' that can be configured to operatively couple to a voltage source 124 through a current limiting resistor or varistor 126.

According to various embodiments, the one or more electrodes 116 can include an electrode 116*b* configured to be operatively coupled to a voltage source 124. Additionally or alternatively, the electrode 116*b* can be configured to be operatively coupled to the voltage source 124 through a current limiting resistor or varistor 128.

According to various embodiments, the one or more electrodes 116 can include an electrode 116*b* configured to provide an electric charge source 116*b*' or an electric field electrode to the combustion reaction 102. Additionally or alternatively, the electrode 116*b* can be configured to provide an electric charge source 116*b*' or an electric field electrode to the stream of fuel 110. The electric charge source 116*b*' can include a sharp tip or serrations on the electrode 116*b*.

According to various embodiments, the one or more electrodes 116 can include a coupling surface 130 configured to be held by the dielectric body 114 outside the combustion volume 106. The one or more electrodes 116 can include a coupling surface 130 configured to make an electrical connection to a voltage source 124. Additionally or alternatively, the one or more electrodes 116 can include a coupling surface 130 configured to make an electrical connection to an electrical ground 122. Additionally or alternatively, the coupling surface 130 can be configured to make an electrical connection to an electrical conductor operatively coupled to the voltage source 124 or electrical ground 122 disposed outside the combustion volume 106.

According to various embodiments, the dielectric body 114 can include a mounting structure 132 configured to be mounted to the combustor wall 104. The mounting structure 132 can include a flange. The flange can include a plurality of bores 134 configured to accept fasteners 136 for mounting the dielectric body 114 onto the combustor wall 104. The plurality of bores 134 can include a plurality of compression-reinforcing cylinders 138 configured to protect the refractory material of the dielectric body 114 from crush damage.

According to various embodiments, the dielectric body 114 can be configured to be mounted to or removed from the combustor wall 104 as a unit. Additionally or alternatively, the dielectric body 114 and the one or more electrodes 116 can be configured to be coupled to and removed from the combustor wall 104 as a unit.

According to various embodiments, the dielectric body 114 can be cast to accept insertion of the one or more electrodes 116 therethrough. The dielectric body 114 can define one or more cylindrical voids configured to accept the insertion of the one or more electrodes 116. The one or more electrodes 116 can be cast into the dielectric body 114.

Figure 2:
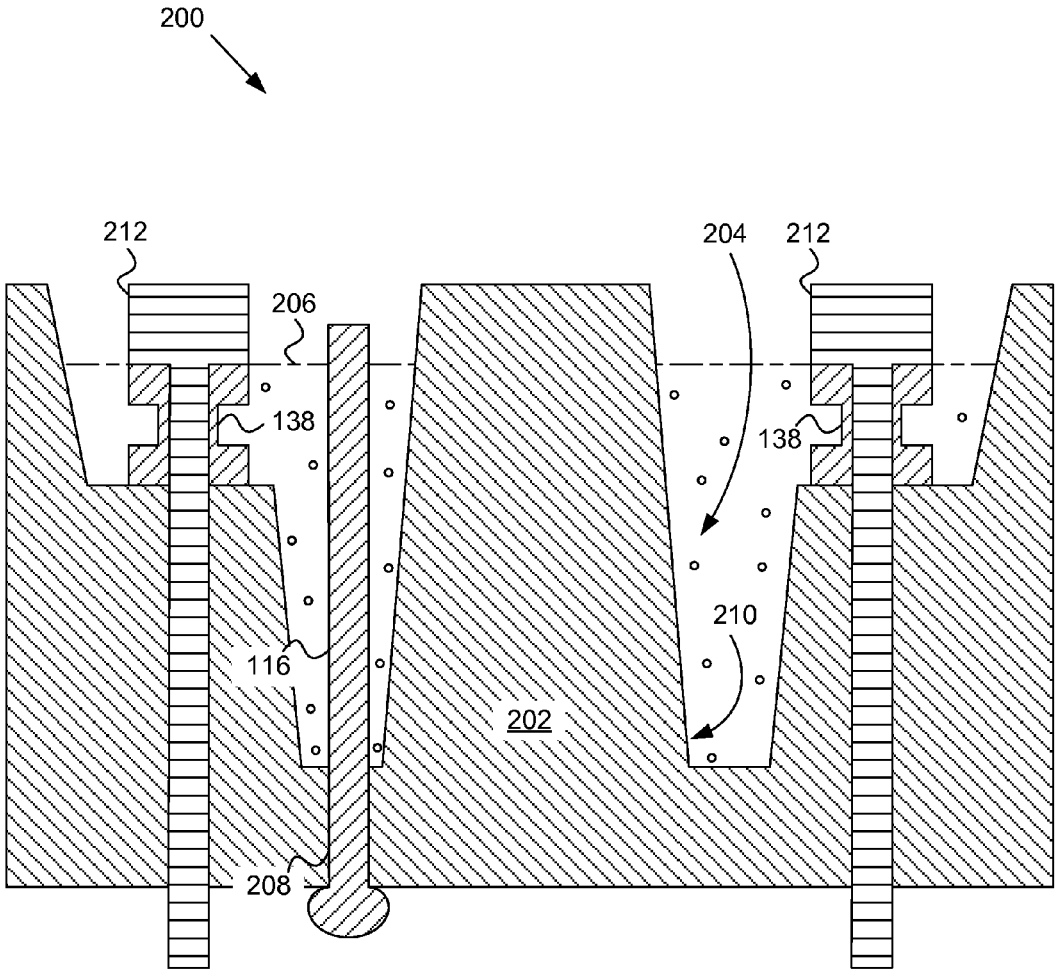
FIG. 2 is a sectional diagram of a casting mold for making the dielectric body of FIG. 1, according to an embodiment.

FIG. 2 is a sectional diagram 200 of a casting mold 202 for making the dielectric body 114 of FIG. 1, according to an embodiment.

According to various embodiments, the dielectric body 114 can be formed by casting the refractory material 206 in a mold cavity 204. The one or more electrodes 116 can be supported in the mold cavity 204 during the formation of the dielectric body 114. During the formation of the dielectric body 114, the refractory material 206 can flow or pack around the one or more electrodes 116 to cause the one or more electrodes 116 to be cast into the dielectric body 114 when the refractory material 206 is hardened. The mold cavity 204 can include at least one via 208 for at least one electrode to extend through the mold cavity wall or bottom 210 such that the at least one electrode extends from the dielectric body 114 when the refractory material 206 is hardened. The one or more electrodes 116 can be configured to provide tensile reinforcement of the dielectric body 114.

According to various embodiments, the dielectric body 114 can include tensile reinforcement. The tensile reinforcement can include the at least one electrode. The tensile reinforcement can include a structure other than the at least one electrode.

According to various embodiments, the dielectric body 114 can be formed in a mold cavity 204 including one or more inserts 212. The one or more inserts 212 can be configured to establish fastener locations in a dielectric body 114 mounting structure 132. The one or more inserts 212 can be configured to register a plurality of compression-reinforcing cylinders 138. The plurality of compression-reinforcing cylinders 138 can be cast into the dielectric body 114. According to various embodiments, the dielectric body 114 can be formed by sand casting the refractory material 206. The cast refractory material 206 can include a cement-bonded material, phosphate-bonded materials, fiber reinforcement, and/or an aggregate particle distribution.

Examples

Examples of the present disclosure include burner structures that integrate one or more electrodes for the application of a charge, voltage, and/or electric field to a flame. A voltage power source can apply a DC or AC voltage to one or more electrodes in proximity to flame, whereby these electrodes can be isolated in a refractory tile included in the burner structure. The refractory tile can permanently hold one or more electrodes for the application of a charge, voltage, and/or electric field to flame, and can provide electrical insulation for avoiding electrical shorts between electrodes, between electrodes and burner structure, and/or between electrodes and ground.

In another embodiment, the refractory tile can include cast passages for allowing electrodes to be inserted, taken out, or interchanged as needed. Cast passages can be formed during manufacturing of refractory tile according to the dimensions, shapes, and desired applications of electrodes within the burner structure.

Further embodiments disclosed in the present disclosure include a single electrode isolated in the refractory tile of the burner structure, whereby AC or DC voltage can be applied to the single electrode for the application of charge, voltage, and/or electric field to flame using star and toroidal patterns. The star and toroidal patterns can be in direct contact with flame, while a portion of the single electrode can be covered by an insulating jacket for avoiding pre-charging of incoming fuel used within burner structure.

FIG. 3 illustrates a burner structure 300 configured for the application of a voltage, charge, and/or electric field to a flame 302, according to an embodiment. The burner structure 300 is configured to support the flame 302 which can be part of a boiler, a water tube boiler, a fire tube boiler, a hot water tank, a furnace, an oven, a flue, a fire tube boiler, a cook top, or the like.

Figure 3A:
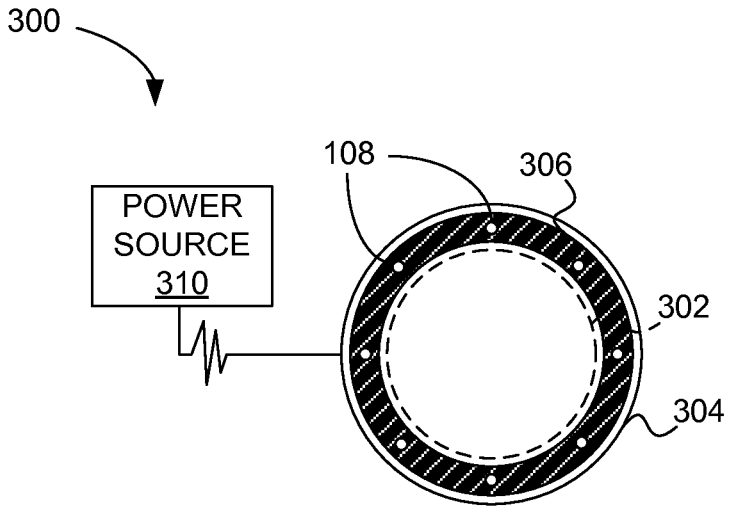
FIG. 3A shows a burner structure that includes a refractory tile for the isolation of one or more electrodes that can apply a voltage, charge, and/or electric field to a flame. Electrodes can exhibit a straight, cylindrical shape, according to an embodiment.

FIG. 3A depicts a top view of a burner structure 300, whereby an optional metal steel casing 304 can provide the shape and structural strength of the burner structure 300. While the present disclosure describes a rounded, cylindrical shape for the metal steel casing 304, other shapes and a variety of dimensions can be contemplated according to the application.

Figure 3B:
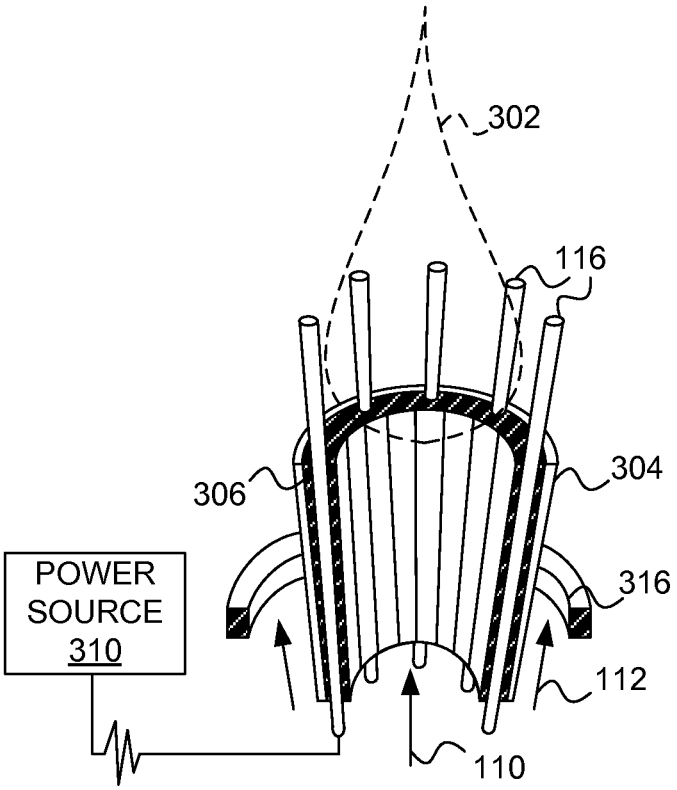
FIG. 3B another view of a burner structure that includes a refractory tile for the isolation of one or more electrodes that can apply a voltage, charge, and/or electric field to a flame of FIG. 3A, according to an embodiment.

A refractory tile 306 can cover the inside diameter of metal steel casing 304. The refractory tile 306 can exhibit a solid structure, as depicted in FIG. 3A, 3B, or it can be configured as a combination of one or more bricks of the refractory tile 306 according to shape and dimensions of the metal steel casing 304. The refractory tile 306 can avoid the flame 302 heat radiation toward the metal steel casing 304 and can also contribute to the stabilization of the flame 302 due the thermal insulating properties of the refractory material. Suitable materials for the refractory tile 306 can include cement bonded materials and phosphate bonded materials. Thickness and materials of the refractory tile 306 can vary according to thermal insulating requirements of the burner structure 300.

In another embodiment, the burner structure 300 can only include the refractory tile 306 within the dimensions and shapes required by the application, without the need of integrating metal steel casing 304 for structural support. Yet in another embodiment, the refractory tile 306 can be slightly taller than the metal steel casing 304.

One or more electrodes 116 can be permanently inserted in the refractory tile 306. In general, castable materials can be preferred for the refractory tile 306 in order to minimize cost when manufacturing complex shapes that can integrate one or more electrodes 116. The electrodes 116 can be made of a suitable conducting material capable of supporting medium to high temperatures.

The electrodes 116 can be operatively connected to a voltage power source 310, whereby AC or DC voltage can be applied to energize or charge electrodes 116. As shown in an angled sectional view of the burner structure 300, FIG. 3B, the fuel 110 can flow through the inside diameter of the refractory tile 306, while air 112 can flow from an inlet port 316, whereby fuel 110 and air 112 can be mixed and ignited to form the flame 302 slightly above the burner structure 300.

As shown in FIG. 3A, 3B, charged electrodes 116 can be isolated by the refractory tile 306, avoiding or at least mitigating the possibility of electrical shorts between electrodes 116, between electrodes 116 and the burner structure 300, and between electrodes 116 and ground.

Notice in FIG. 3B, a section of electrodes 116 can extend out of the refractory tile 306 to apply a charge, voltage, and/or electric field in the surroundings or through the flame 302. This protuberant section of the electrodes 116 can be in proximity to or direct contact with the flame 302. The length of the protuberant section of the electrodes 116 can depend on flame dimensions, as well as the desired electrical characteristics to be induced on the flame 302.

The electrodes 116 can be charged by the voltage power source 310 in a variety of configurations to apply a charge, voltage, and/or electric field to the flame 302. For example, all electrodes 116 can be connected in parallel to a single voltage power source 310. In another embodiment, one half of electrodes 116 can be connected in parallel to a first voltage power source 310, while the other half electrodes 116 can be connected in parallel to a second voltage power source 310. Yet in another embodiment, each electrode 116 can connect to an independent voltage power source 310.

Although the burner structure 300 and the electrodes 116 are shown in respective shapes and geometric relationships, other geometric relationships and shapes can be contemplated. For example, the electrodes 116 can exhibit a serrated shape, while the burner structure 300 can also exhibit a variety of configurations as described herein.

Referring now to FIG. 4, a burner structure 400 is configured for the application of a voltage, charge, and/or electric field to the flame 302, according to an embodiment. The burner structure 400 is configured to support flame the 302.

The burner structure 400 can include the same components and can exhibit similar operation as the burner structure 300, but with a modification in the shape and orientation of electrodes 116. As depicted in cross-sectional view of the burner structure 400, FIG. 4B, the protuberant section of electrodes 116 can be bent toward the center of the burner structure 400, at an angle ranging from 0 to 90 degrees, for example. The bend can increase direct contact with the flame 302 or can bring the electrodes closer to but not in contact with the flame 302.

Figure 4A:
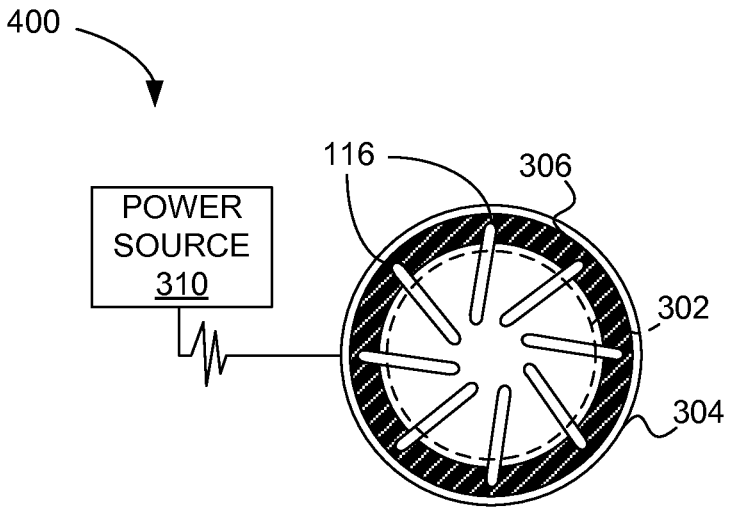
FIG. 4A illustrates a burner structure that includes a refractory tile for the isolation of one or more electrodes that can apply a voltage, charge, and/or electric field to a combustion reaction. Electrodes can be slightly bended toward the center of burner structure, according to an embodiment.
Figure 4B:
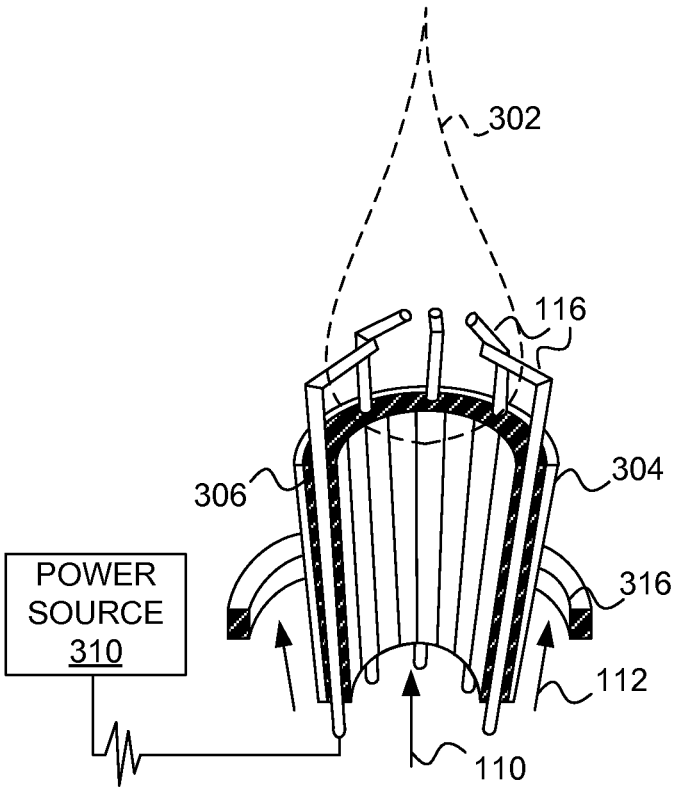
FIG. 4B shows another view of a burner structure that includes a refractory tile for the isolation of one or more electrodes that can apply a voltage, charge, and/or electric field to a flame of FIG. 4A, according to an embodiment.

A corresponding top view, FIG. 4A, depicts the protuberant section of electrodes 116 oriented toward the center of burner structure 400.

Figure 5:
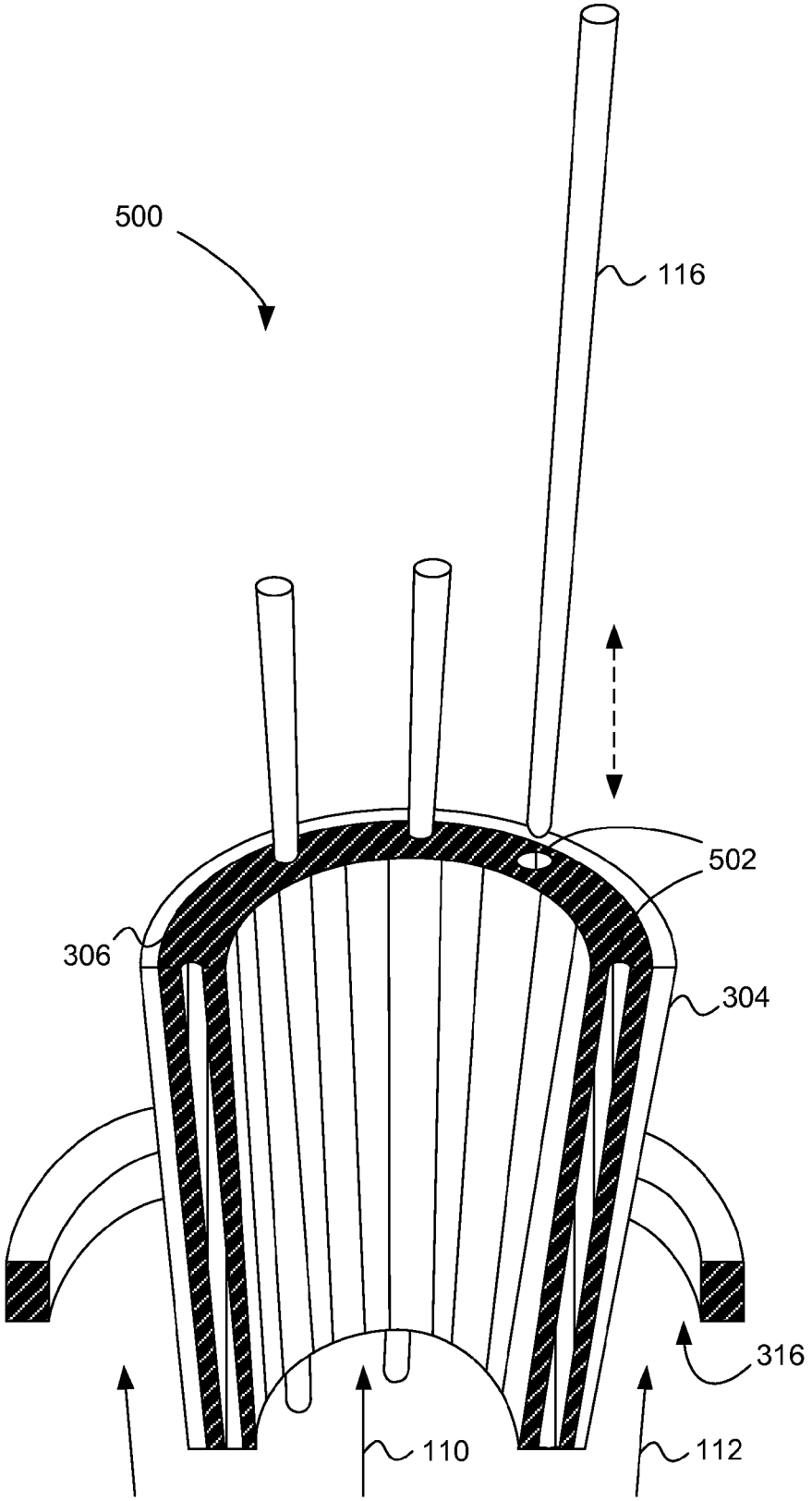
FIG. 5 depicts a burner structure that includes a refractory tile with cast passages for the isolating of one or more electrodes that can apply a voltage, charge, and/or electric field to a flame, according to an embodiment.

FIG. 5 shows a burner structure 500, which represents an embodiment of the burner structures 300, 400, where cast passages 502 can be formed in refractory tile 306 to hold one or more electrodes 116. Cast passages 502 can allow electrodes 116 to be inserted and taken out of the refractory tile 306 as needed. That is, the formation of cast passages 502 in refractory tile 306 can allow the burner structures 300, 400 to use a variety of electrodes 116 in different configurations as required by the application.

The length and thickness of the cast passages 502 in the refractory tile 306 can vary according to dimensions of electrodes 116. Conserving the scope of previous embodiments, electrodes 116 contained in cast passages 502 of the refractory tile 306 can be properly isolated to avoid electrical shorts between electrodes 116, between electrodes 116 and the burner structures 300, 400, and between the electrodes 116 and ground, when applying a charge, voltage, and/or electric field to the flame 302.

Forming the refractory tile 306 with or without cast passages 502 can involve known refractory manufacturing processes which can include mixing raw materials and forming into desired shapes and dimensions under wet or moist conditions; followed by heating the refractory material to high temperatures in a periodic or continuous tunnel kiln to form the ceramic bond that gives the refractory tile 306 its refractory properties; and concluding with a final processing stage that can involve milling, grinding, and sandblasting of the refractory tile 306.

Figure 6A:
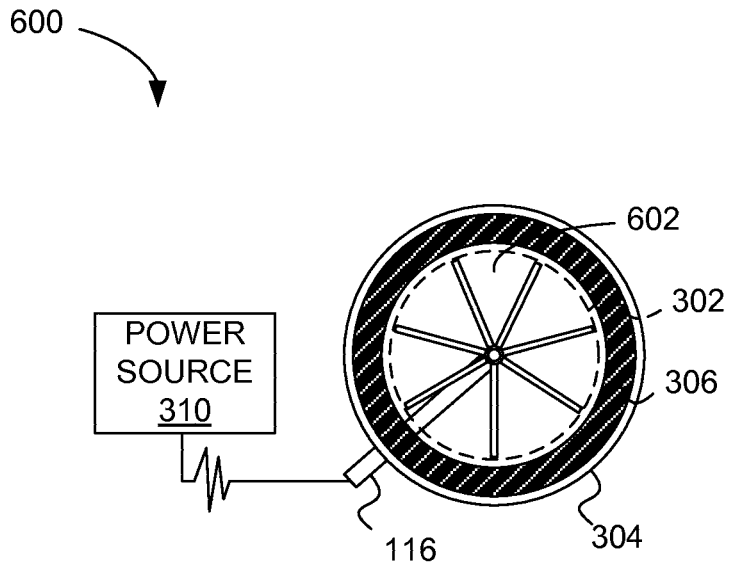
FIG. 6A illustrates a burner structure that includes a refractory tile for the isolation of a single electrode that can apply a voltage, charge, and/or electric field to a flame. Single electrode can exhibit a star pattern in contact with the flame, according to an embodiment.

Referring now to FIG. 6, a burner structure 600 is configured for the application of a voltage, charge, and/or electric field to the flame 302, according to an embodiment. The burner structure 600 is configured to support the flame 302.

Compared to the burner structures 300, 400, the burner structure 600 can also include metal steel casing 304 in conjunction with the refractory tile 306, but with the difference of just including a single electrode 116. Electrode 116 can be operatively coupled to the voltage power source 310, whereby AC or DC voltage can be applied to energize electrode 116. As depicted in top view, FIG. 6A, electrode 116 can exhibit a star pattern 602 which can be in contact with the flame 302 for the application of charge, voltage, and/or electric field.

Figure 6B:
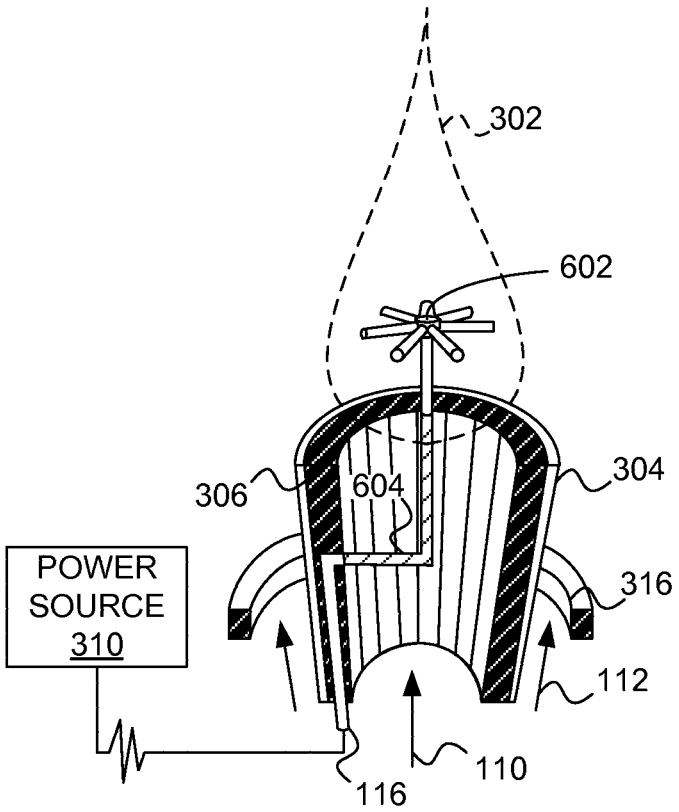
FIG. 6B is another view of the burner structure that includes a refractory tile for the isolation of a single electrode that can apply a voltage, charge, and/or electric field to a flame of FIG. 6A, according to an embodiment

As shown in cross-sectional view, FIG. 6B, the electrode 116 can be isolated within the refractory tile 306 to avoid electrical shorts to the burner structure 600 or ground, while a portion of the electrode 116 can be covered by an insulating jacket 604. The insulating jacket 604 can be omitted from the star pattern 602 to allow this section of the electrode 116 to contact the flame 302 for the application of voltage. Suitable materials for the insulating jacket 604 can include ceramics or the same refractory materials used in the refractory tile 306. In an embodiment, the insulating jacket 604 can be formed from fused quartz glass.

Figure 7A:
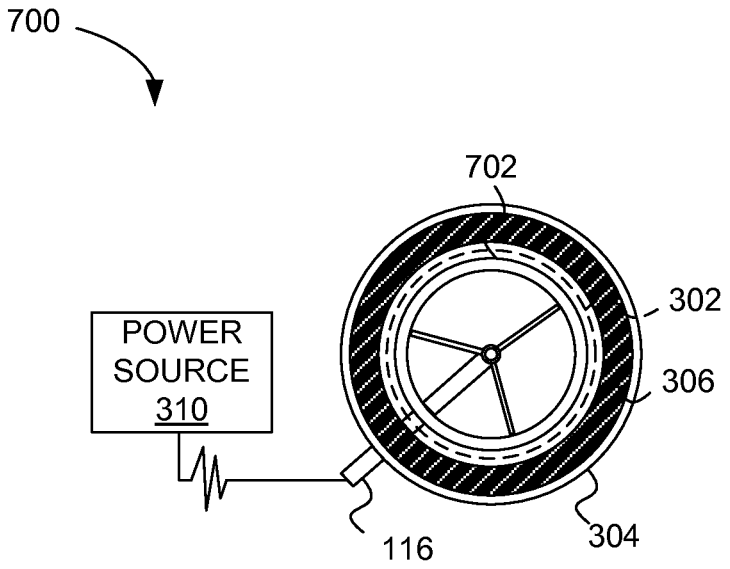
FIG. 7A is a top view of a burner structure that includes a refractory tile for the isolation of a single electrode that can apply a voltage, charge, and/or electric field to a flame. Single electrode can exhibit a toroidal pattern in contact with the flame, according to an embodiment.
Figure 7B:
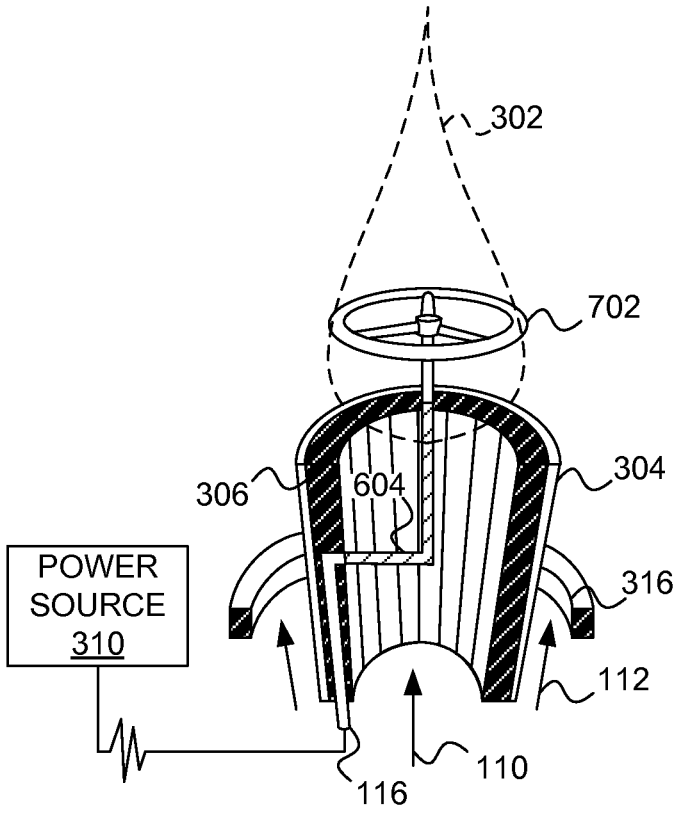
FIG. 7B another view of the burner structure that includes a refractory tile for the isolation of a single electrode that can apply a voltage, charge, and/or electric field to a flame of FIG. 7A, according to an embodiment.

FIG. 7 illustrates a burner structure 700 as another embodiment of the burner structure 600. As can be seen in top view, FIG. 7A, the electrode 116 can include a toric section 702 configured to be held in contact with a flame 302 for the application of voltage to the flame.

Similarly to the burner structure 600, the electrode 116 in the burner structure 700 can also be isolated within the refractory tile 306 for avoiding electrical short to the burner structure 700 or ground, and can also include an insulating jacket 604. As the voltage power source 310 charges the electrode 116, the toric section 702, which is not covered by the insulating jacket 604, can apply corresponding voltage to the flame 302.

In another embodiment, the toric section 702 can include coils or windings to induce a magnetic field in the flame 302.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A burner configured for application of electrical energy to a combustion reaction, comprising:

a combustor wall disposed to at least partially bound a combustion volume to separate the combustion volume from an external volume;

at least one fuel nozzle configured to output a stream of fuel into the combustion volume to support a combustion reaction in the combustion volume;

at least one air flow passage configured to at least allow air to enter the combustion volume to support the combustion reaction;

a dielectric body extending at least partly into the combustion volume, the dielectric body being formed from a cast refractory material; and one or more electrodes extending substantially through the dielectric body, the one or more electrodes being configured to convey electrical energy from the external volume to a location proximate to or coincident with the combustion reaction;

wherein a protuberant section of at least one of the electrodes is positioned inside the combustion volume so as to be in direct contact with a flame.

2. The burner configured for application of electrical energy to a combustion reaction of claim 1, wherein the dielectric body is configured to operate, under at least one condition, as a bluff body for holding the combustion reaction.

3. The burner configured for application of electrical energy to a combustion reaction of claim 1, wherein the dielectric body is configured to at least partly define the at least one air flow passage.

4. The burner configured for application of electrical energy to a combustion reaction of claim 1, wherein the at least one fuel nozzle is configured to direct at least a portion of at least one stream of fuel to impinge onto the dielectric body.

5. The burner configured for application of electrical energy to a combustion reaction of claim 1, wherein the dielectric body is configured to electrically insulate or electrically isolate the one or more electrodes extending substantially therethrough along all or a portion of the one or more electrodes.

6. The burner configured for application of electrical energy to a combustion reaction of claim 1, wherein the one or more electrodes includes an electrode configured to be operatively coupled to an electrical ground.

7. The burner configured for application of electrical energy to a combustion reaction of claim 1, wherein the one or more electrodes includes an electrode configured to provide a combustion reaction support point.

8. The burner configured for application of electrical energy to a combustion reaction of claim 7, wherein the electrode configured to provide a combustion reaction support point is configured to operatively couple to ground or to a voltage source through a current limiting resistor.

9. The burner configured for application of electrical energy to a combustion reaction of claim 1, wherein the one or more electrodes includes an electrode configured to be operatively coupled to a voltage source.

10. The burner configured for application of electrical energy to a combustion reaction of claim 9, wherein the electrode is configured to be operatively coupled to the voltage source through a current limiting resistor.

11. The burner configured for application of electrical energy to a combustion reaction of claim 1, wherein the one or more electrodes includes an electrode configured to provide an electric charge source or an electric field electrode to the combustion reaction or the stream of fuel.

12. The burner configured for application of electrical energy to a combustion reaction of claim 11, wherein the electric charge source includes sharp tip or serrations on the electrode.

13. The burner configured for application of electrical energy to a combustion reaction of claim 1, wherein the one or more electrodes includes a coupling surface configured to be held by the dielectric body outside the combustion volume, the coupling surface being configured to make an electrical connection to a voltage source, an electrical ground, or an electrical conductor operatively coupled to the voltage source or electrical ground disposed outside the combustion volume.

14. The burner configured for application of electrical energy to a combustion reaction of claim 1, wherein the dielectric body includes a mounting structure configured to be mounted to the combustor wall.

15. The burner configured for application of electrical energy to a combustion reaction of claim 14, wherein the mounting structure includes a flange.

16. The burner configured for application of electrical energy to a combustion reaction of claim 14, wherein the flange includes a plurality of bores configured to accept fasteners for mounting the dielectric body onto the combustor wall.

17. The burner configured for application of electrical energy to a combustion reaction of claim 16, wherein the plurality of bores include a plurality of compression-reinforcing cylinders configured to protect the refractory material of the dielectric body from crush damage.

18. The burner configured for application of electrical energy to a combustion reaction of claim 1, wherein the dielectric body is configured to be mounted to or removed from the combustor wall as a unit.

19. The burner configured for application of electrical energy to a combustion reaction of claim 1, wherein the dielectric body and the one or more electrodes are configured to be coupled to and removed from the combustor wall as a unit.

20. The burner configured for application of electrical energy to a combustion reaction of claim 1, wherein the dielectric body defines one or more cylindrical voids configured to accept the insertion of the one or more electrodes.

21. The burner configured for application of electrical energy to a combustion reaction of claim 1, wherein the one or more electrodes are cast into the dielectric body.

22. The burner configured for application of electrical energy to a combustion reaction of claim 21, wherein the dielectric body is formed by casting the refractory material in a mold cavity; and wherein the one or more electrodes is supported in the mold cavity during the formation of the dielectric body such that the refractory material flows or packs around the one or more electrodes to cause the one or more electrodes to be cast into the dielectric body when the refractory material is hardened.

23. The burner configured for application of electrical energy to a combustion reaction of claim 22, wherein the mold cavity includes at least one via for at least one electrode to extend through the mold cavity wall or bottom such that the at least one electrode extends from the dielectric body when the refractory material is hardened.

24. The burner configured for application of electrical energy to a combustion reaction of claim 21, wherein the one or more electrodes are configured to provide tensile reinforcement of the dielectric body.

25. The burner configured for application of electrical energy to a combustion reaction of claim 1, wherein the dielectric body includes tensile reinforcement.

26. The burner configured for application of electrical energy to a combustion reaction of claim 25, wherein the tensile reinforcement includes the at least one electrode.

27. The burner configured for application of electrical energy to a combustion reaction of claim 25, wherein the tensile reinforcement includes a structure other than the at least one electrode.

28. The burner configured for application of electrical energy to a combustion reaction of claim 1, wherein the dielectric body is formed in a mold cavity including one or more inserts configured to establish fastener locations in a dielectric body mounting structure.

29. The burner configured for application of electrical energy to a combustion reaction of claim 28, wherein the one or more inserts are configured to register a plurality of compression-reinforcing cylinders; and wherein the plurality of compression-reinforcing cylinders are cast into the dielectric body.

30. The burner configured for application of electrical energy to a combustion reaction of claim 1, wherein the dielectric body is formed by sand casting the refractory material.

31. The burner configured for application of electrical energy to a combustion reaction of claim 1, wherein the cast refractory material includes a cement-bonded material.

32. The burner configured for application of electrical energy to a combustion reaction of claim 1, wherein the cast refractory material includes a phosphate bonded materials.

33. The burner configured for application of electrical energy to a combustion reaction of claim 1, wherein the cast refractory material includes fiber reinforcement.

34. The burner configured for application of electrical energy to a combustion reaction of claim 1, wherein the cast refractory material includes an aggregate particle distribution.

35. The burner configured for application of electrical energy to a combustion reaction of claim 1, further comprising a metal casing disposed about an outside diameter of the dielectric body.

36. The burner configured for application of electrical energy to a combustion reaction of claim 1, wherein the cast refractory material of the dielectric body comprises a plurality of refractory tile bricks.

37. The burner configured for application of electrical energy to a combustion reaction of claim 1, wherein the dielectric body forms an annular structure, the at least one air flow passage is disposed outside the annular structure, and one or more of the at least one fuel nozzles is configured to provide the stream of fuel at an interior of the annular structure of the dielectric body.

38. The burner configured for application of electrical energy to a combustion reaction of claim 1, wherein the one or more electrodes are permanently affixed through the dielectric body.

39. The burner configured for application of electrical energy to a combustion reaction of claim 1, wherein a protuberant section of each of the one or more electrodes extends out of the dielectric body.

40. The burner configured for application of electrical energy to a combustion reaction of claim 39, wherein the protuberant section of each of the one or more electrodes is angled toward a center of the burner structure, each protuberant section configured for contact with or increased proximity to the combustion reaction.

41. The burner configured for application of electrical energy to a combustion reaction of claim 1, wherein the one or more electrodes includes a single electrode that extends from the dielectric body and splits into a plurality of tips.

42. The burner configured for application of electrical energy to a combustion reaction of claim 41, further comprising an insulating covering disposed on a portion of the single electrode between the dielectric body and the plurality of tips.

43. The burner configured for application of electrical energy to a combustion reaction of claim 1, wherein the one or more electrodes includes a single electrode that extends from the dielectric body and splits into a plurality of extensions, each extension conductively joined with a toric section, the toric section disposed for contact with the combustion reaction.

44. The burner configured for application of electrical energy to a combustion reaction of claim 43, wherein the toric section includes a coil of conductive material that generates a magnetic field when the single electrode receives an electrical current.

45. The burner configured for application of electrical energy to a combustion reaction of claim 1, wherein the dielectric body is cast to accept insertion therethrough, and to allow taking out therefrom, of at least one of the electrodes extending substantially through the dielectric body.

* * * * *